US007915837B2

(12) United States Patent
Shloush et al.

(10) Patent No.: US 7,915,837 B2
(45) Date of Patent: Mar. 29, 2011

(54) MODULAR PROGRAMMABLE LIGHTING BALLAST

(75) Inventors: Moshe Shloush, Knoxville, TN (US); Gregory Davis, Maynardville, TN (US)

(73) Assignee: Lumetric, Inc., Fremont, CA (US)

( * ) Notice: Subject to any disclaimer, the term of this patent is extended or adjusted under 35 U.S.C. 154(b) by 197 days.

(21) Appl. No.: 12/418,755

(22) Filed: Apr. 6, 2009

(65) Prior Publication Data

US 2010/0244721 A1 Sep. 30, 2010

Related U.S. Application Data

(60) Provisional application No. 61/043,175, filed on Apr. 8, 2008.

(51) Int. Cl.
*G05F 1/00* (2006.01)
*H05B 39/04* (2006.01)

(52) U.S. Cl. ..... 315/291; 315/307

(58) Field of Classification Search ..... 315/291, 315/307, 292, 293, 294, 295, 308, 309, 310, 315/311

See application file for complete search history.

(56) References Cited

U.S. PATENT DOCUMENTS

| | | | |
|---|---|---|---|
| 4,100,476 | A | 7/1978 | Ghiringhelli |
| 4,207,497 | A | 6/1980 | Capewell et al. |
| 4,207,498 | A | 6/1980 | Spira et al. |
| 4,210,846 | A | 7/1980 | Capewell et al. |
| 4,396,872 | A | 8/1983 | Nutter |
| 4,598,232 | A | 7/1986 | Nilssen |
| 4,652,797 | A | 3/1987 | Nilssen |
| 4,851,739 | A | 7/1989 | Nilssen |
| 4,862,040 | A | 8/1989 | Nilssen |
| 4,874,989 | A | 10/1989 | Nilssen |
| 4,928,039 | A | 5/1990 | Nilssen |
| 4,935,669 | A | 6/1990 | Nilssen |
| 4,939,430 | A | 7/1990 | Droho |
| 4,988,920 | A | 1/1991 | Hoeksma |
| 4,999,547 | A | 3/1991 | Ottenstein |
| 5,303,910 | A | 4/1994 | McGill et al. |
| 5,457,360 | A | 10/1995 | Notohamiprodjo et al. |
| 5,458,075 | A | 10/1995 | Tice et al. |
| 5,459,375 | A | 10/1995 | Nilssen |

(Continued)

FOREIGN PATENT DOCUMENTS

EP 0698336 A4 2/1996

(Continued)

OTHER PUBLICATIONS

HIB Electronic Ballast, ROMlight International Inc., 2 pages, [online] [Retrieved on Jun. 6, 2009] Retrieved from the internet <URL:http://www.romlightintl.com/ballasts.cfm>.

(Continued)

*Primary Examiner* — Douglas W Owens
*Assistant Examiner* — Minh D A
(74) *Attorney, Agent, or Firm* — The Mueller Law Office, P.C.

(57) ABSTRACT

A lighting ballast is programmable as to input and output parameters. Both operational characteristics and sensed data are used to control the ballast parameters. The ballast is configured to recapture as electrical energy heat produced by the lamp. The ballast is constructed in modular fashion with a power factor correction circuit module and a ballast control circuit module that snap together to achieve a large number of input voltage and lamp type variations with a small number of separate units.

17 Claims, 5 Drawing Sheets

100

U.S. PATENT DOCUMENTS

| | | | | |
|---|---|---|---|---|
| 5,489,823 | A | 2/1996 | Nilssen | |
| 5,530,322 | A | 6/1996 | Ference et al. | |
| 5,550,439 | A | 8/1996 | Nilssen | |
| 5,608,291 | A | 3/1997 | Nilssen | |
| 5,623,256 | A | 4/1997 | Marcoux | |
| 5,661,468 | A | 8/1997 | Marcoux | |
| 5,691,603 | A | 11/1997 | Nilssen | |
| 5,736,819 | A | 4/1998 | Nilssen | |
| 5,757,140 | A | 5/1998 | Nilssen | |
| 5,839,382 | A | 11/1998 | Tice et al. | |
| 5,990,634 | A | 11/1999 | Brown | |
| 6,107,749 | A | 8/2000 | Nilssen | |
| 6,135,040 | A | 10/2000 | Tice et al. | |
| 6,138,241 | A | 10/2000 | Eckel et al. | |
| 6,232,727 | B1 | 5/2001 | Chee et al. | |
| 6,297,612 | B1 | 10/2001 | Shloush et al. | |
| 6,385,732 | B1 | 5/2002 | Eckel et al. | |
| 6,486,615 | B2 | 11/2002 | Hui et al. | |
| 6,650,067 | B1 | 11/2003 | Shloush et al. | |
| 6,791,458 | B2 | 9/2004 | Baldwin | |
| 7,098,598 | B2 | 8/2006 | Kraus et al. | |
| 7,109,668 | B2 * | 9/2006 | Pogodayev et al. | 315/307 |
| 7,129,647 | B2 | 10/2006 | DuLaney et al. | |
| 7,180,251 | B2 | 2/2007 | van Eerden | |
| 7,235,932 | B2 | 6/2007 | Crandall et al. | |
| 7,239,094 | B2 * | 7/2007 | Radzinski et al. | 315/307 |
| 7,252,406 | B2 | 8/2007 | Crandall | |
| 7,262,559 | B2 | 8/2007 | Tripathi et al. | |
| 7,307,386 | B2 | 12/2007 | Fishbein et al. | |
| 7,309,975 | B2 | 12/2007 | Fishbein et al. | |
| 7,355,354 | B2 | 4/2008 | Rust et al. | |
| 7,369,060 | B2 | 5/2008 | Veskovic et al. | |
| 7,388,334 | B2 | 6/2008 | Crandall et al. | |
| 7,521,873 | B2 * | 4/2009 | Hui et al. | 315/219 |
| 7,650,323 | B2 | 1/2010 | Hesse et al. | |
| 7,659,673 | B2 * | 2/2010 | Lys | 315/247 |
| 7,688,005 | B2 | 3/2010 | Reid | |
| 7,737,643 | B2 * | 6/2010 | Lys | 315/291 |
| 7,747,357 | B2 | 6/2010 | Murdoch | |
| 7,765,033 | B2 | 7/2010 | Perry | |
| 7,800,319 | B2 | 9/2010 | Raneri | |
| 2007/0041181 | A1 | 2/2007 | Shofar | |
| 2008/0258633 | A1 | 10/2008 | Voysey | |
| 2009/0243517 | A1 | 10/2009 | Verfuerth et al. | |
| 2010/0181935 | A1 | 7/2010 | Wu | |

FOREIGN PATENT DOCUMENTS

| | | | |
|---|---|---|---|
| EP | 1196012 | A2 | 4/2002 |
| EP | 1493621 | A2 | 1/2005 |
| EP | 1615479 | A2 | 1/2006 |
| EP | 1724909 | A2 | 11/2006 |
| EP | 1754933 | A1 | 2/2007 |
| WO | WO 2005/043955 | | 5/2005 |

OTHER PUBLICATIONS

HIB Electronic High Bay Fixtures, ROMlight International Inc., 2 pages, [online] [Retrieved on Jun. 6, 2009] Retrieved from the internet <URL:http://www.romlightintl.com/fixtures.cfm>.

Data sheet: Metrolight Smart Electronic Ballast for HID™ 250/320/350/400/450 Watt, Metrolight Inc., 2007, 2 pages, Can be retrieved from the internet <URL:http://www.metrolight.com>.

Crockett, J., "Dimmable Ballasts: Consider Digital," Consulting—Specifying Engineer, Specifier's Notebook, Aug. 2006, 1 page.

"Lumenergi Executive Summary," Lumenergi LLC, Nov. 21, 2006, 2 pages.

Dilouie, C., "Dali XP Draft Standard Promises Major Breakthrough in Digital Lighting," Lighting Controls Association, Sep. 2008, 3 pages [online] [Retrieved on Jul. 14, 2009] Retrieved from the internet <URL:http://www.aboutlightingcontrols.org/education/papers/2008_dalixp.shtml>.

Yarris, L., "Feeling the Heat: Berkeley Researchers Make Thermoelectric Breakthrough in Silicon Nanowires," Research News Berkeley Lab, Jan. 9, 2008, 3 pages [online] [Retrieved on Jul. 14, 2009] Retrieved from the internet <URL:http://www.lbl.gov/Science-Articles/Archive/MSD-silicon-nanowires.html>.

"IEPC Corporation, VB Sales," Process Register, Last Updated Jul. 13, 2009, 1 page [online] [Retrieved on Jul. 14, 2009] Retrieved from the internet <URL:http://www.processregister.com/IEPC_Corporation_VB_Sales/Supplier/sid7582.htm>.

"Greening the Lighting Industry for High Performance with LED Systems (IPEC)," California Green Solutions, 4 pages [online] [Retrieved on Jul. 14, 2009] Retrieved from the internet <URL:http://www.californiagreensolutions.com/cgi-bin/gt/tpl.h,content=1719>.

"IEPC International Engineering Products & Consulting: VB400 Lighting Control Optimizes HID Lamp Performance," New Equipment Digest, May 29, 2007, 1 page [online] [Retrieved on Jul. 14, 2009] Retrieved from the internet <URL:http://www.newequipment.com/303/ProductDetail/61958/VB400_Lighting_Control_Optimizes_HID_Lamp_Performance.aspx>.

Product News—"Lighting Control System suits fluorescent applications," Sep. 19, 2007; Original Press Release: "VBC Lighting Control Now Available for Fluorescent Applications," Aug. 27, 2007, ThomasNet Industrial NewsRoom, 6 pages [online] [Retrieved on Jul. 14, 2009] Retrieved from the internet <URL:http://news.thomasnet.com/fullstory/804617>.

Product News—"Lighting Control offers efficient option for HID users," May 31, 2007; Original Press Release: "VB400 Lighting Control Saves Energy and Costs Over T5/T8 Replacements," May 8, 2007, ThomasNet Industrial NewsRoom, 4 pages [online] [Retrieved on Jul. 14, 2009] Retrieved from the internet <URL:http://news.thomasnet.com/fullstory/518726>.

Company Profile for IEPC Corp., Last Modified Mar. 9, 2008, [online] [Retrieved on Mar. 9, 2008] Retrieved from the internet <URL:http://www.thomasnet.com/profilenews.html?cid=10111507&navsec=news&WT.mc_t=INR&WT.mc_n =minf>.

"IEPC Corp.'s Re-Lamping Program Ensures Brightness, Energy Savings Over Time," IEPC Corporation International Engineering Products & Consulting, May 8, 2007, 3 pages, can be retrieved at <URL:http://recmgmt.com/rmnews/0508.relamping.pr.pdf>.

"Getting the Most Lighting for the Buck," Electrical Contracting Products, Cygnus Business Media, Jul. 8, 2008, 8 pages [online] [Retrieved on Jul. 14, 2009] Retrieved from the internet <URL:http://www.ecpzone.com/publication/article.jsp?publd=2&id=2669&pageNum=1>.

International Engineering Products and Consulting Corporation Homepage, IEPC Corp., 1 page [online] [Retrieved on Jul. 14, 2009] Retrieved from the internet <URL:http://www.iepc.cc/?page=home>.

LUM Energy—Company, Lumenergi, 2006, 3 pages [online] [Retrieved on Dec. 18, 2007] Retrieved from the internet <URL:http://www.lumenergi.com/company.html>.

LUM Energy—Lighting, Lumenergi, 2006, 1 page [online] [Retrieved on Dec. 18, 2007] Retrieved from the internet <URL:http://www.lumenergi.com/lighting.html>.

Cortese, A., "'Green' Buildings Don't Have to Be New," The New York Times, Jan. 27, 2008, 5 pages [online] [Retrieved on Feb. 5, 2008] Retrieved from the internet <URL:http://www.nytimes.com/2008/01/27/realestate/c...c9d361&ex=1202360400&emc=eta1&pagewanted=print>.

High Intensity Discharge Lighting Technology Workshop Report, Nov. 15, 2005, 170 Pages.

"e-Vision—Delivering performance that drives your business forward," Halogen Conversion Brochure, Advance Transformer Co., 2008, 12 Pages.

"The ABC's of High Intensity Discharge (HID) Ballast," Advance Transformer Co., 2005, 24 Pages.

"Products and Services," DC Velocity, Feb. 2008, 1 Page, [online] [Retrieved on Jul. 20, 2009] Retrieved from the internet <URL:http://www.dcvelocity.com/products/?product_id=1007>.

"Advance Introduces Power New e-Vision® Electronic HID Ballast for Two 39W Metal Halide Lamps," Lighting Controls Association, 1 Page, [online] [Retrieved on Jul. 20, 2009] Retrieved from the internet <URL:http://www.aboutlightingcontrols.org/products/newprods/advance/advance-20060906.shtml>.

"Navigating New Worlds in Light," Brochure, MagneTek, Universal Triad, 2000, 4 Pages.
"L.A. County Slashes Energy Costs 77% With Retrofit Using MagneTek Electronic Ballasts," Protraits #7, MagnTek, Jul. 30, 1998, 2 Pages.
"Luminoptics Changes Name to Lumenergi," News Release, Lumenergi, Apr. 25, 2006, 2 Pages.
Office Action dated Nov. 26, 2010 for U.S. Appl. No. 12/482,570.

* cited by examiner

100

500

MODULAR PROGRAMMABLE LIGHTING BALLAST

CROSS REFERENCE TO RELATED APPLICATIONS

This application claims the benefit of U.S. Provisional Application No. 61/043,175, entitled "Modular Programmable Lighting Ballast," filed Apr. 8, 2008, which is incorporated by reference in its entirety.

BACKGROUND

This invention relates generally to lighting ballasts, and more particularly to improved ballasts for high intensity discharge lighting devices.

Some types of electric lighting devices, such as gaseous discharge lamps, require electrical power of a different type than is normally available directly from electric utility mains. Furthermore, such devices often require electrical power of a different type for starting up than for maintaining illumination once started. In addition, certain operational benefits derive from varying the characteristics of the electrical power provided from a ballast to a lamp.

Many types of lamps powered by ballasts generate, as an inherent aspect of their operation, significant amounts of heat as well as light. In most applications, this heat is not desired and is considered waste, thus reducing the overall efficiency of the lighting system of which the lamp forms a part.

Depending on the application desired, ballasts may be needed that operate on different mains input voltages, phases, frequencies and the like. Further, depending on the application desired, ballasts may be needed that provide different electrical characteristics to the lamps they are driving. As a result, ballast providers must stock a large number of different parts (or "SKUs"), each of which must be separately ordered and inventoried. The large variety of ballasts needed for common applications thus requires electrical equipment suppliers to maintain an inventory of many parts, some of which may sit unsold for a long time, thus using warehouse space in a less than optimal manner.

Known disclosures, such as U.S. Pat. No. 7,129,647, have described some efforts to address some of the aforementioned issues, but a need remains for improved control of the electricity provided to lamps using a programmable ballast.

SUMMARY

In accordance with the present invention, a lighting ballast is programmable as to input and output electrical parameters. In one embodiment, the input parameters are programmable such that the ballast can operate on a variety of input voltages (e.g., 120 or 240 volts) and phases (e.g., single phase, three phase). In another embodiment, the output parameters are programmable such that the ballast can provide electrical output to different types of lamps. In still another embodiment, the output parameters are programmable such that the ballast can provide electrical output selected for a particular application (e.g., a traditional start-up or a "gentle" start-up for longer life). In one embodiment, the ballast is programmed automatically based on sensed conditions, such as temperature, length of daylight, presence of vehicle lights, and the like. In another embodiment, the ballast is programmed remotely.

Also in accordance with the present invention, the ballast is configured to be positioned so as to absorb heat generated by the lamp that the ballast is powering, and to generate electrical energy from that heat so as to increase the overall efficiency of the lighting system of which it forms a part. In one aspect of the invention, a thermoelectric converter charges a capacitor or other storage subsystem for energy reuse.

Still further in accordance with the present invention, the ballast is constructed in modular fashion such that a power factor correction (PFC) circuit is provided independently from a ballast control circuit. The PFC circuit is configured to accept power in any of several mains voltage, amperage, frequency and phase combinations, and to produce therefrom a standard intermediate feed output. The ballast control circuit is configured to accept as input the standard intermediate feed from the PFC circuit and produce therefrom a lamp operating output. In one aspect of the invention, a number of PFC circuits are provided, each configured to inexpensively and efficiently work with any one standard set of mains voltage, frequency and phase combinations for a given lamp wattage. A number of ballast control circuits are also provided, each configured to correspond to a set of compatible lamps. The PFC circuits and ballast circuits are configured in modular form such that they may readily be assembled into a complete ballast unit.

BRIEF DESCRIPTION OF THE DRAWINGS

The disclosed embodiments have other advantages and features which will be more readily apparent from the detailed description, the appended claims, and the accompanying figures (or drawings). A brief introduction of the figures is below.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
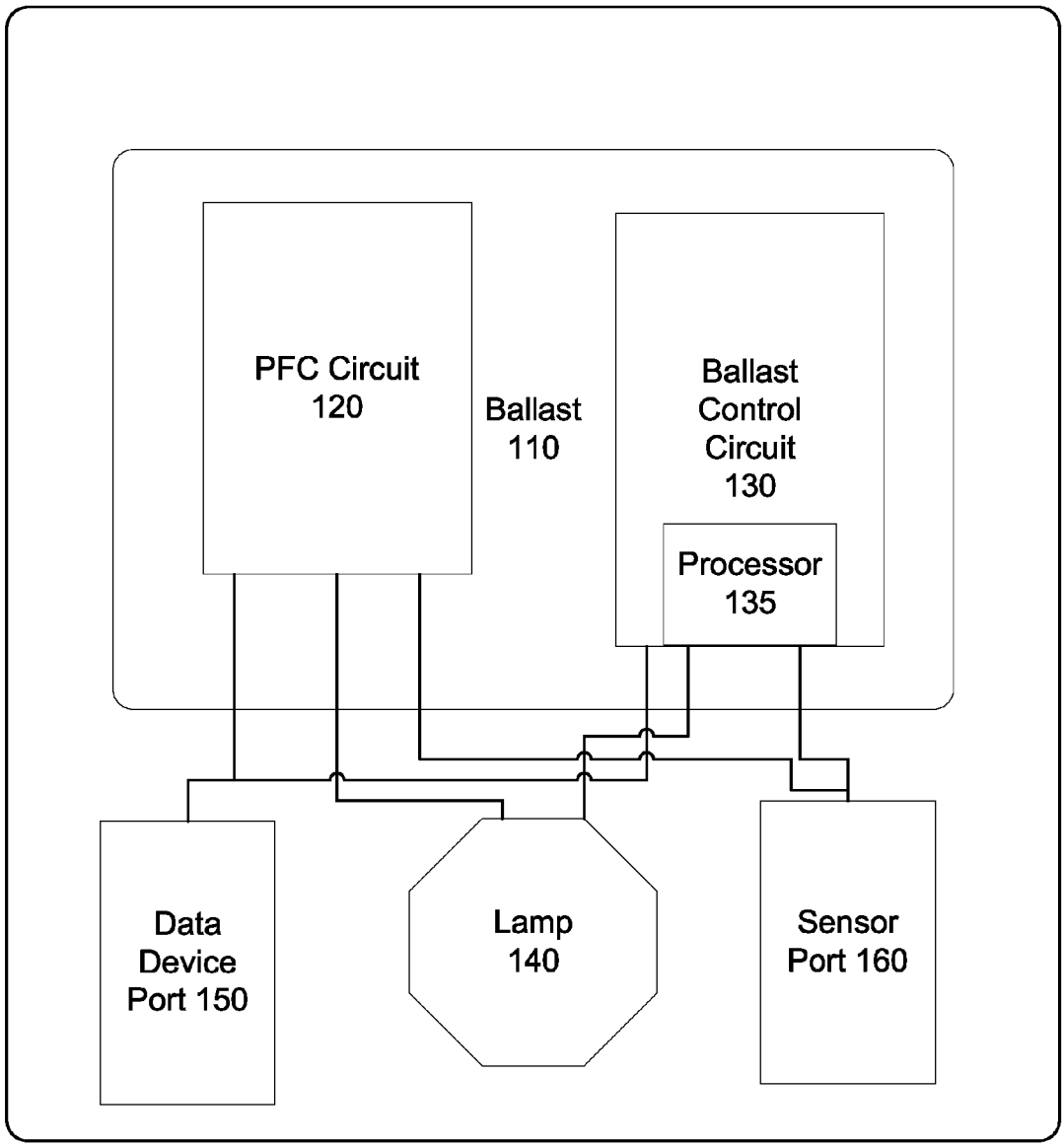
FIG. 1 is a system block diagram of a luminaire including a ballast and a lamp.

FIG. 1 illustrates in block diagram form a luminaire 100, including a ballast 110 and a lamp 140. In a preferred embodiment, lamp 140 is a high intensity discharge lamp, such as a metal halide lamp or a high pressure sodium lamp. In other embodiments, other types of lamps for which ballast control is desirable are used for lamp 140. Ballast 110, described in greater detail below, is in a preferred embodiment a programmable ballast including a power factor correction (PFC) circuit 120 and a ballast control circuit 130. PFC circuit 120 phase-shift corrects AC mains power supplied from an electrical utility provider and then converts it into DC power that is supplied to the ballast control circuit 130. Ballast control circuit 130 converts the DC power to a form of electrical power more readily usable by lamp 140. For example, mains power may be 120 volt, 60 Hz sine wave single phase power, yet it may be desirable for lamp 140 to be started using a pulsed high voltage, higher frequency square wave or modified sine wave to strike and establish the arc within lamp 140 that provides light, and then transition to lower voltage and still higher frequency square wave feed to maintain the arc at a desired firing rate in once the lamp has established an arc and warmed up to operating temperature. As detailed further in the discussion of FIGS. 2 and 3 below, PFC circuit 120 and ballast control circuit 130 convert the input mains feed into one of these forms usable by lamp 140.

PFC circuit 120 converts mains power into filtered DC power supplying ballast control circuit 130. In one embodiment, PFC circuit 120 senses the specific type of mains power to which luminaire 100 is connected, and programmatically adjusts operational aspects of PFC circuit 120 accordingly. For example, in one particular embodiment, PFC circuit 120 is configured to be programmably operable on mains feeds ranging from 120 volt single phase through 480 volt three phase, at either 50 or 60 Hz in frequency. Conventional multi-feed ballast circuits are designed merely to have components that can operate on several different types of input power, but at reduced efficiency compared with a primary expected input. In contrast, PFC circuit 120 forms a control loop to modify its internal operations to achieve essentially equal efficiency at any of the anticipated input power waveforms within its range of operation.

Coupled to PFC circuit 120 is ballast control circuit 130. As detailed further in the discussion of FIG. 3 below, ballast control circuit 130 is configured to control the power waveform output to lamp 140. Once lamp type has been determined, in one configuration ballast control circuit 130 further maintains lamp wattage at a constant level, in order to compensate for minor variations in lamp output due to ambient conditions, aging, and minor manufacturing variations among lamps of the same type. Programming of ballast control circuit 130 in this manner is in some applications for aesthetic value (e.g., where multiple lamps are used to light an architectural object) and in other applications for purposes of increasing efficiency, safety, and lamp life.

Ballast control circuit 130 is also configured to fire lamp 140 in various ways depending on the application of luminaire 100 and internal programming. Different firing waveforms of lamp 140 are shown in practice to result in different operating characteristics. While one firing waveform may ignite lamp 140 in compliance with traditional standards, another may be more "gentle" in that it results in longer life for lamp 140 and requires less of a power surge on startup, which may be an issue in certain applications, particularly those powered by smaller generators rather than the mains grid. Different applications may call for different priorities among these operating characteristics. For example, a luminaire 100 installed in a location that is very difficult or expensive to replace lamp 140 that has reached its end of life may call for the more gentle waveform, while other "lighting on demand" applications may put a priority on providing more illumination from luminaire 100.

When a high intensity discharge lamp is first started, i.e., the gas inside the lamp is cool, it tends to strike much more readily than when it is restarted with the gas still warm. The difference in time needed for a cold strike and a hot restrike can be considerable. With traditional ballast circuits, hot restrikes may take up to twenty minutes to accomplish. As described in greater detail below, in one embodiment a thermistor is placed adjacent to the lamp. If such a thermal sensor is available, information from it is fed back to ballast control circuit 130 so that an appropriate waiting time can be determined without a futile attempt to restrike the lamp before it has cooled sufficiently. This thermal information is also usable to ensure that the proper lamp has been installed for use with the ballast. Based on temperature changes with operation, an alert flag is raised if an improper lamp has been inserted, and the alert flag is used to either turn off the system or issue an alarm so that the proper lamp can be installed. In related applications, it may be desired to automatically turn on lamps in response to some sensed condition, such as presence of an automobile at nearby streetlight. In such situations, by knowing the lamp temperature, timing of a command to turn on the light can be adjusted based on whether it is a hot restrike or a cold strike, so that the lamp reaches the desired illumination at the desired time.

In addition to a temperature sensor such as described in the previous paragraph, in various embodiments other sensors are used in connection with ballast control circuit 130. A daylight sensor is used not only for conventional day/night determination, but also for determination of length of day and, based on that, dimming during periods of expected minimal traffic in remote areas. Another light sensor, aimed at a roadway adjacent to luminaire 110, senses approaching traffic and increases rumination to assist drivers during periods of expected minimal traffic in remote areas. In an alternate embodiment, remote sensors, such as located proximally to another luminaire, communicate with luminaire 100 to give advance warning of approaching traffic so that full illumination is achieved before the approaching vehicles get to the area illuminated by luminaire 100.

Ballast control circuit 130 includes a processor 135. In some embodiments, luminaire 100 also includes a data device port 150 and a sensor port 160. Data device port 160 is configured for connection with a computer, terminal or other data device for various applications as may be desired. Sensor port 160 is configured for connection to environmental and other sensors as described below. Both ports 150 and 160 have data connections to ballast control circuit 130 so as to allow programmable control and communications using processor 135, as well as power connections to PFC circuit 120 (or in an alternate embodiment, to ballast control circuit 130) to allow the ports 150 and 160 to provide a power source to devices that are connected thereto, as appropriate for each connected device. For example, in one application a motion sensor is connected to sensor port 150. Rather than requiring a sensor that includes capabilities such as threshold determination, hysteresis setting, timing functions and the like, in such application an inexpensive "dumb" motion sensor is used and such additional functionality is implemented by processing capabilities already at the ballast, e.g., via processor 135.

Ports 150 and 160 are both intended for general purpose use with a variety of connected devices. Additional flexibility is achieved by the ports being configurable for either unidirectional or bidirectional communications, under any of a number of conventional communications protocols. In one embodiment, each of ports 150, 160 includes Uniform Serial Bus (USB), Ethernet, Wi-Fi (802.11) and single-wire bus connections with auto-detect of which is connected at any particular time.

Figure 2:
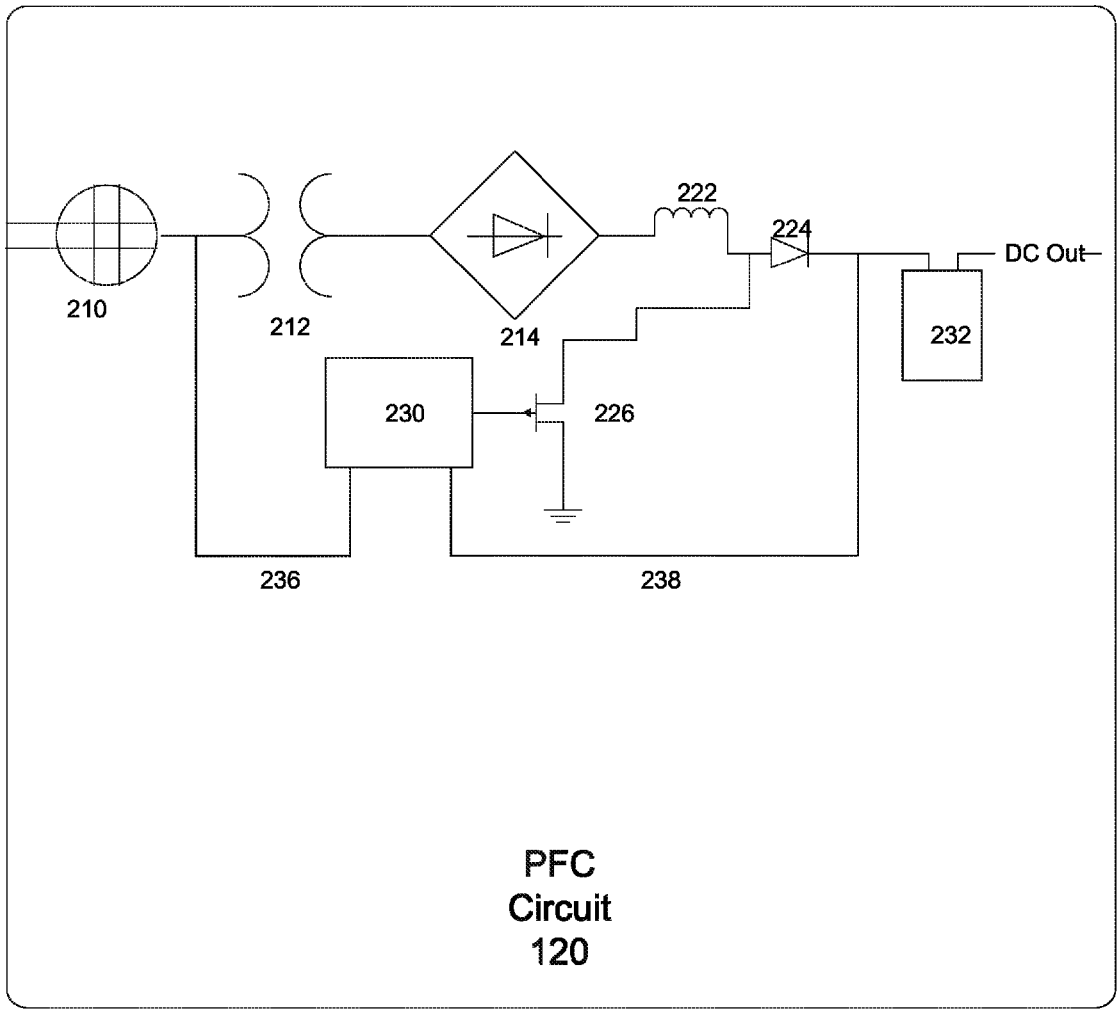
FIG. 2 is a circuit diagram of a PFC circuit.

Referring now to FIG. 2, a circuit diagram of PFC circuit 120 is shown. This circuit diagram includes, for simplicity of description, only major functional components used for the discussion herein; those skilled in the art will recognize that other subsystems and components, such as those for noise filtering, safety and the like, are also included in accordance with best practices of the electrical engineering field.

PFC circuit 120 includes a mains connection 210 for connecting to the utility power grid. In common industrial lighting applications, between 208 and 277 volts single-phase AC feeds are provided to HID lighting fixtures. Traditional PFC circuits that include a range of acceptable input voltages have widely varying efficiencies over those input voltages, essentially "dumping" energy in the form of heat for non-optimal input voltages within the acceptable range. From the mains connection 210 power is provided to a conventional full bridge rectifier circuit 214 after initial filtering and surge protection represented by filter circuitry 212. Filter circuitry 212 also prevents any EMI generated within PFC circuit 120 and any circuits or devices connected to DC OUT. Bridge rectifier 214, choke 222 and capacitive charge pump subcircuit (referred to herein simply as "capacitor") 232 reduce AC fluctuations to provide a steady DC voltage of 450 volts to feed ballast control circuit 130. Diode 224 is included to prevent reverse current flow.

In addition to these components, a digital signal controller integrated circuit 230 is also included in PFC circuit 120. In one embodiment, a Texas Instruments series TMS320-series device is used for DSC IC 230, though other integrated circuits can be used as well. DSC IC 230 is configured to accept as input both the input waveform 236 and the output waveform, and, based on programming as described below, find the best fit operating frequency for the input line conditions, resulting in a more efficient workload of PFC circuit 120. A more efficient workload drives the circuit less and results in less dumping of heat than would otherwise be possible.

In a traditional PFC, a FET (e.g., 226) would operate at a preset frequency that is optimal for a given mains 210 input voltage, such as 277 volts, and the DC OUT would be a bus voltage such as 450 volts. The frequency of the FET sets the current, e.g., from choke 222, to steadily keep a capacitor, e.g., 232, efficiently charged. If the input voltage varies from the design norm, for instance 208 volts rather than 277, the PFC must work longer to maintain charge in capacitor 232 due to the lower input voltage and the resulting change in current. By working longer, FET 226 must dump more energy as heat, which is typically considered undesirable.

By providing the input mains waveform 236 and the DC OUT waveform 238 as inputs to the DSC IC 230, programming of DSC IC 230 allows it to select different switching frequencies for cycling FET switch 226 that will be more efficient. Specifically, by monitoring the DC OUT waveform 238, DSC IC 230 determines voltage drop and consumption by circuits and devices connected to DC OUT. When energy is drawn from DC OUT and capacitor 232, DSC IC 230 adjusts the operating frequency of the FET 226 to a value that is most efficient to charge capacitor 232. In a preferred embodiment, DC OUT monitoring is performed on the input side of capacitor 232; in an alternate embodiment monitoring of DC OUT is performed on the output side of capacitor 232.

To determine the optimal frequency, in one embodiment DSC IC 230 uses predetermined/scaled values from a stored table determined by the input mains waveform 236. In another embodiment, DSC IC 230 uses DC OUT waveform as feedback in a control loop configuration. DSC IC 230 monitors DC OUT waveform 238 for voltage drop of a certain amount and when such drop is detected begins cycling FET 226 at a predetermined frequency. When the voltage is restored, again by monitoring DC OUT waveform 238, FET 226 is turned off. DSC IC 230 records the time duration of this operation and the current FET 236 frequency. On the second indication of voltage drop, the operation is repeated, except DSC IC 230 nominally adjusts the FET 236 frequency arbitrarily lower or higher. The time duration of the operation is again recorded and compared to the previous recorded duration. If the new duration is longer, then the frequency is nominally adjusted in the opposite direction; if the duration is shorter, the frequency is again nominally adjusted in the same direction. The operation is repeated to shorten the time duration that FET 236 operates (i.e., turns on to shunt current from the anode of diode 224 to ground) as long as the traditional purposes of a PFC circuit (e.g., synchronizing the power factor) are maintained within acceptable limits.

Figure 3:
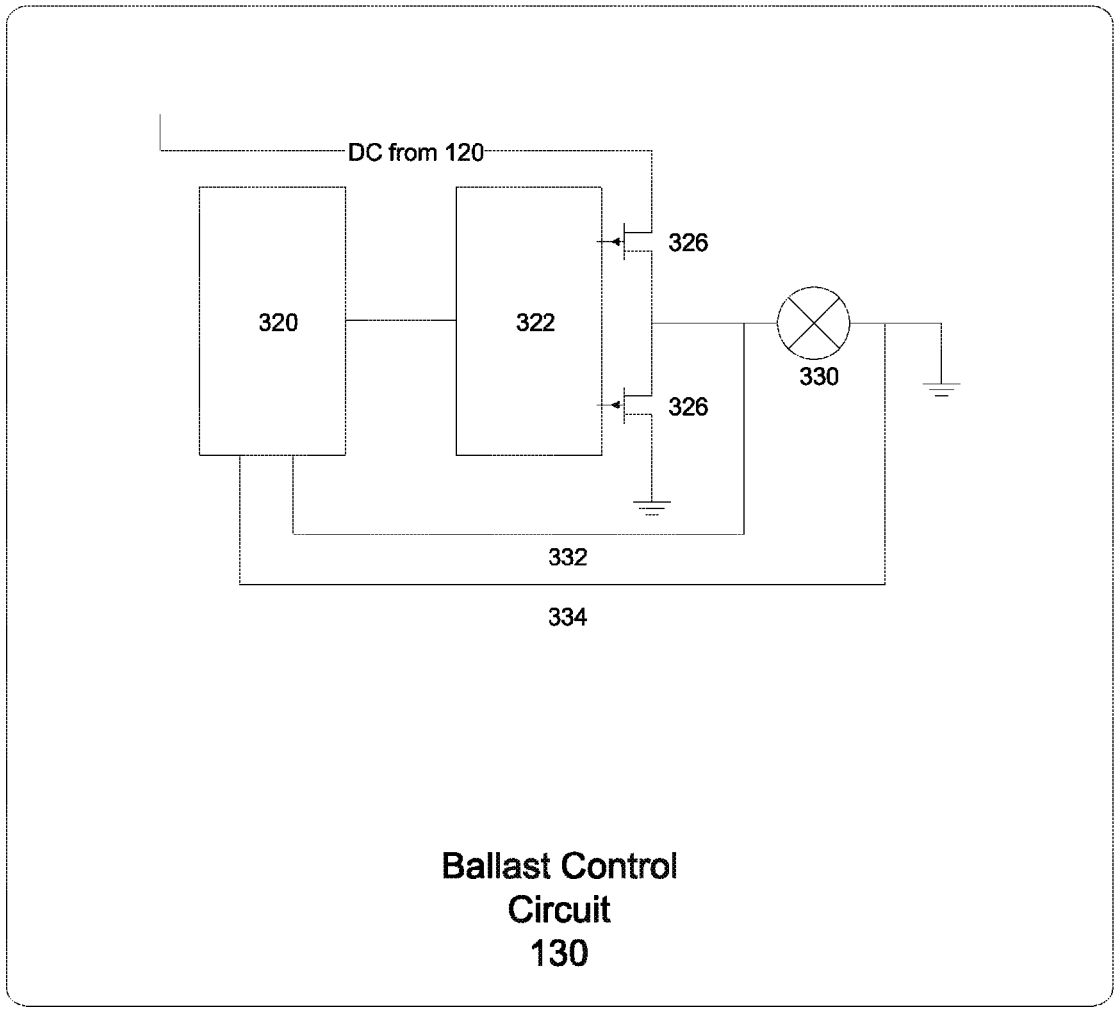
FIG. 3 is a circuit diagram of a ballast control circuit.

Referring now to FIG. 3, a circuit diagram of Ballast Control Circuit 130 is shown. As with FIG. 2, this circuit diagram includes, for simplicity of description, only major functional components used for the discussion herein; those skilled in the art will recognize that other subsystems and components, such as those for noise filtering, safety and the like, are also included in accordance with best practices of the electrical engineering field.

An input from PFC Circuit 120 provides DC power to the Ballast Control Circuit 130. Ballast Control Circuit 130 includes a digital signal controller integrated circuit 320 (which in some embodiments also serves as processor 135 referenced in FIG. 1). In one embodiment, a Texas Instruments series TMS320-series device is used for DSC IC 320, though other integrated circuits can be used as well including the sharing of DSC IC 230 in PFC 120. DSC IC 320 outputs a desired waveform for the lamp characteristics that are of interest via integrated features such as rapidly changing the frequency of a PWM signal in a controlled manner to mimic a sinusoidal output. The waveform output of DSC IC 320 is connected to a conventional dual gate amplifying drive 322, which amplifies the waveform to operate FET switches 326 which provide power to lamp 330. In some applications, switches 326 are implemented by multiple sets of FET switches (2, 4, 6 etc.) as needed to achieve desired power handling capabilities.

Variations of the waveform are desired based on the current lamp state (on/off/dimming level), lamp type, lamp wattage, and the like. An advantage of this design is that any desired waveform can be generated by DSC IC 320, with variations in frequency, amplitude, wave shape, current, voltage, deadtime and the like as desired for the lamp characteristics that are of interest.

In another embodiment in which only a single waveform shape is desired for the lamp, dual gate amplifying drive 322 is replaced with a self-oscillating dual gate driver (not shown) conventionally coupled with other components (not shown) to generate a waveform of the desired shape. The frequency of the waveform is input from DSC IC 320 via conventional means such as PWM signals, serial commands, or analog command signal.

In another embodiment of the previous circuits, inputs to DSC IC 320 are waveform sensors 332 and 334 that report waveform characteristics at lamp 330. For example, in one embodiment waveform sensor 334 is a signal indicative of current flowing through lamp 330 as detected by a shunt sensor (not shown). Programming of DSC IC 320 allows it to monitor the power characteristics supplied to lamp 330 via sensors 332 and 334 and make adjustments as required to hold any desired parameter within an intended range.

For example, unless a lamp is being dimmed, its wattage should not change. In practice, however, a lamp's wattage does change as it ages due to chemistry changes and electrode erosion within the lamp that modify its resistance. To maintain constant wattage over the life of a lamp, DSC IC 320 processes as input the wattage of lamp 330 and adjusts the waveform characteristics as needed to maintain constant wattage over time.

In some applications, the primary concern may be with only changes in one direction, e.g., calling for increase in wattage as a lamp ages and gets naturally dimmer. In still other applications, there may be some constraints that must be observed, e.g., maintaining supplied power below a threshold voltage to prevent premature lamp failure. Programming of DSC IC 320 readily allows changes to be made in accordance with any such desired considerations. By logging such changes over time, information can also be collected about anticipated lamp life and related aspects that may be of interest, particularly where the effort or cost of lamp replacement is high.

Figure 4:
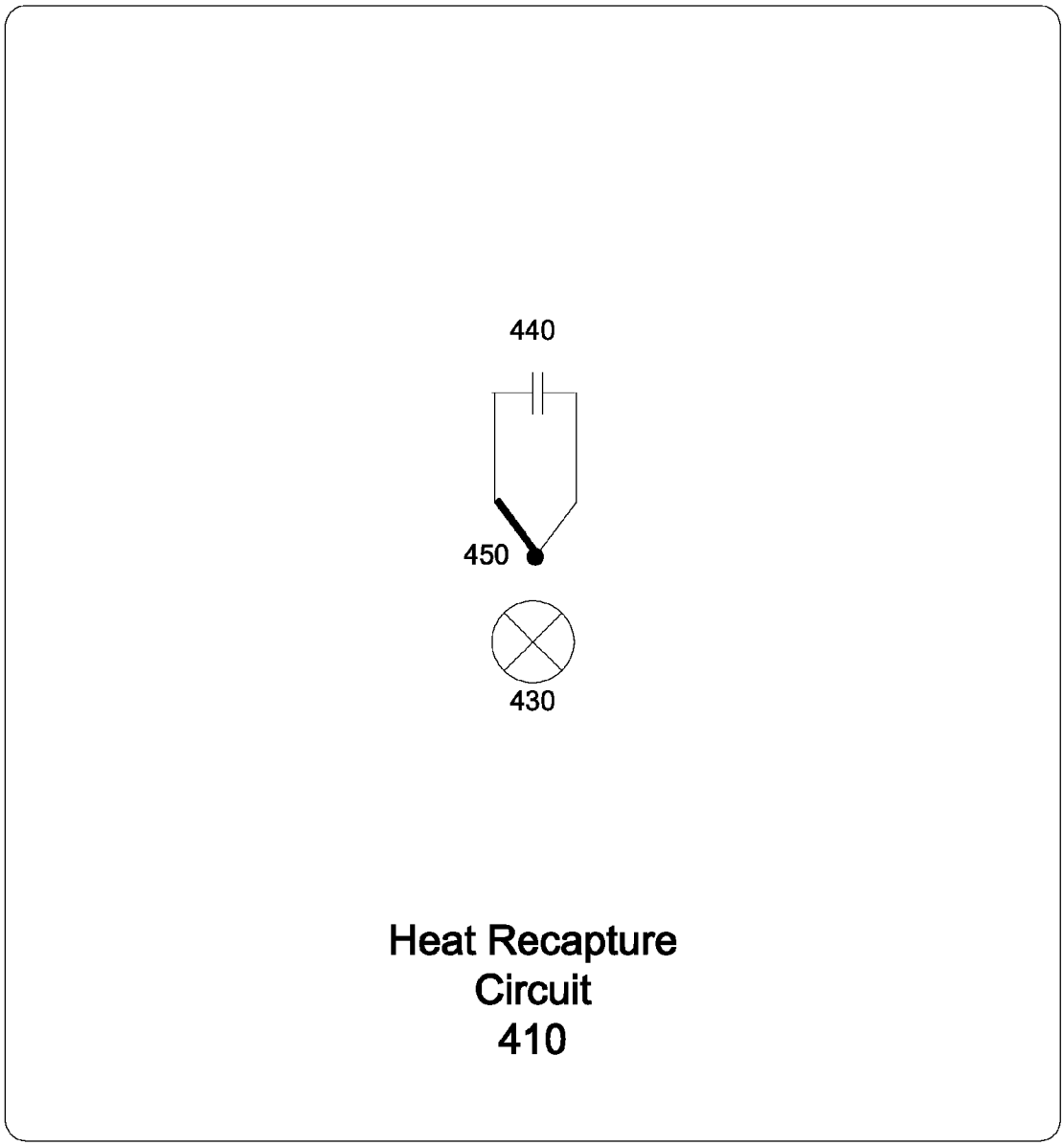
FIG. 4 is a circuit diagram of a heat recapture circuit.

Referring now to FIG. 4, a circuit diagram of heat recapture circuit 410 is shown. As with the prior figures, this circuit diagram includes, for simplicity of description, only major functional components used for the discussion herein; those skilled in the art will recognize that other subsystems and components, such as those for noise filtering, safety and the like, are also included in accordance with best practices of the electrical engineering field.

As many HID lamps produce significant quantities of heat as well as light, if such heat is not considered desirable (e.g., for heating a space in which the lamps are located) then such heat is wasted energy and reduces the overall efficiency of the lamps. In one simplified embodiment for purposes of illustration, heat recapture circuit 410 includes a thermocouple 450 located above lamp 430 and a capacitor 440. Heat generated by lamp 430 warms thermocouple 450, and the energy created thereby is stored as electrical energy in capacitor 440. In actual practice, Seebeck Effect devices are more efficient than a conventional thermocouple and are used to produce electrical energy from the heat above lamp 430, and a storage system circuit rather than simply a capacitor 440 is used to store the electrical energy in a manner that allows the energy to be re-introduced into the lamp circuit, supplementing the electrical energy provided by ballast control circuit 130. In practice, a lamp socket (not shown) absorbs more heat from the lamp than the heat that is simply escaping into the air; heat recapture circuit 410 includes thermocouple 450 directly connected to, or integrated with, the lamp socket. In one embodiment, thermocouples 421 are conventional T-Type thermocouples; in an alternate embodiment, other known means of converting heat or temperature differences into electricity are used.

Figure 5:
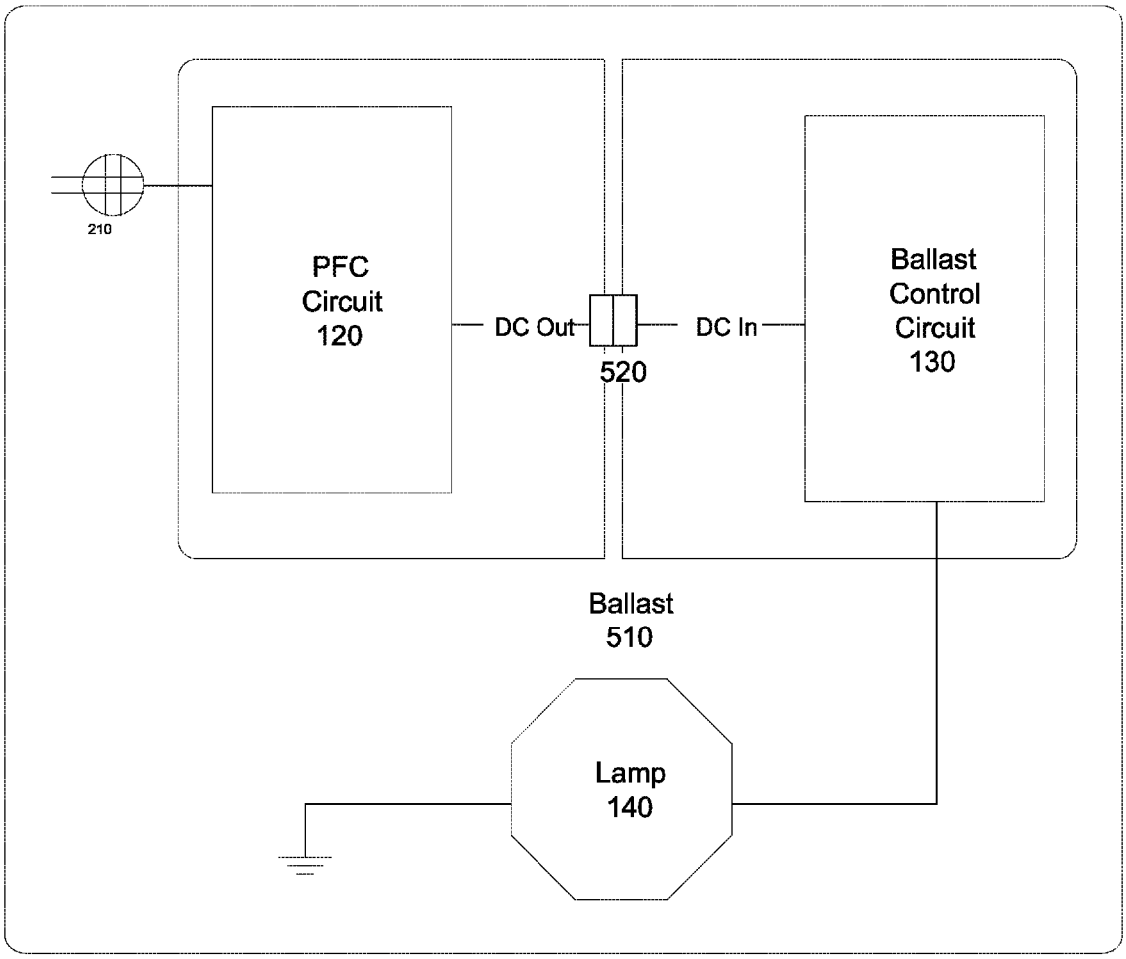
FIG. 5 illustrates modular construction of a luminaire.

Referring now to FIG. 5, luminaire 500 is preferably constructed with ballast 510 having independent modules providing PFC circuit 120 and ballast control circuit 130. As noted above, conventional lighting ballasts are sold in a large number of configurations, based on variations in input mains characteristics as well as characteristics of the lamps they are intended to drive. Ballast 510 includes a connector 520 into which PFC circuit 120 and ballast control circuit 130 snap together to form the complete ballast 510. In practice, it is found that by making PFC circuits 120 operable at particular subsets of mains 210 power parameters (e.g., one for 120-240 volt single phase, another for 240 volt three phase, and a third for 480-600 volt three phase), and by making ballast controller circuits operable for particular subsets of lamp types (e.g., one for mercury vapor lamps, another for metal halide lamps and a third for high pressure sodium lamps), inexpensive PFC and control subsystems can be combined as needed for a variety of possible combinations. Using the examples given, a non-modular approach would require nine separate ballasts to handle the input voltage and lamp-type combinations mentioned above, while the modular approach requires only three PFC circuits and three ballast control circuits (a total of six products). As variations become greater, the benefits of such modular approach increase even more. For five input possibilities and five lamp types, the non-modular approach requires 25 different ballasts while the modular approach requires only ten products (five each of PFCs and ballast control circuits). By providing PFC circuit 120 and ballast control circuit 130 as units with independent enclosures that snap together to form the complete ballast 510, vendors providing such components need stock fewer parts in order to provide a full range of ballast capabilities to customers.

In one embodiment, independent module PFC 120 and independent ballast control module 130 are connected together via external connection 520. Connection 520 is a male/female connection in one embodiment and a connection to a backplane in an alternate embodiment. Mains input power 210 is supplied to PFC module 120. PFC 120 filters and modifies the power and supplied DC power out to connector 520. Ballast control module 130 receives DC power from connector 520, produces a desired waveform and supplies it to lamp 140.

In another embodiment, connector 520 provides not only power from PFC 120 to ballast control module 130, but also two-way communication signals between modules so that resources such as microprocessors and sensors may be shared.

SUMMARY

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a tangible computer readable storage medium or any type of media suitable for storing electronic instructions, and coupled to a computer system bus. Furthermore, any computing systems referred to in the specification may include a single processor or may be architectures employing multiple processor designs for increased computing capability.

Embodiments of the invention may also relate to a computer data signal embodied in a carrier wave, where the computer data signal includes any embodiment of a computer program product or other data combination described herein. The computer data signal is a product that is presented in a tangible medium or carrier wave and modulated or otherwise encoded in the carrier wave, which is tangible, and transmitted according to any suitable transmission method.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention.

What is claimed is:

1. A luminaire, comprising:

a lamp;

a processor;

a power factor correction circuit configured to operate at an operating frequency, receive a main power supply, and generate an intermediate power supply based on said operating frequency; and a ballast operatively coupled to said lamp, configured to receive said intermediate power supply, and generate a lamp power supply based on a control waveform;

wherein said processor can adjust said operating frequency, sense said main power supply, calculate a best fit operating frequency based on said main power supply and a stored table of values containing a set of values, and adjust said operating frequency to said best fit operating frequency; and wherein each of said values in said stored table of values is a best fit operating frequency given a set main power supply.

2. The luminaire of claim 1, wherein said processor can adjust both said control waveform and said operating frequency.

3. The luminaire of claim 1, further comprising:

a data port configured to communicate with said processor, and communicate with an external device;

wherein said processor adjusts said control waveform or said operating frequency based on information obtained from said data port.

4. The luminaire of claim 1, wherein said processor is configured to:

sense said intermediate power supply;

calculate a best fit operating frequency based on said intermediate power supply; and adjust said operating frequency to said best fit operating frequency.

5. The luminaire of claim 4, wherein said power factor correction circuit achieves near-equal efficiency across a range of potential characteristics of said main power supply.

6. The luminaire of claim 1, wherein said processor is configured to:

sense a set of at least one operating conditions of said lamp;

calculate a desired waveform necessary to keep a desired lamp parameter within a desired range based on said set of at least one operating conditions; and adjust said control waveform to said desired waveform.

7. The luminaire of claim 6, wherein:

an operating condition in said set of at least one operating conditions is a wattage of said lamp; and said desired lamp parameter is also said wattage of said lamp.

8. The luminaire of claim 6, wherein said processor is configured to:

log said set of at least one operating conditions of said lamp in a data file; and calculate said desired waveform based on said data file.

9. A method of providing a lamp power supply to a lamp comprising the steps of:

generating an intermediate power supply from a main power supply using a power factor correction circuit based on an operating frequency of said power factor correction circuit;

generating said lamp power supply from said intermediate power supply using a ballast based on a control waveform of said ballast;

sensing said main power supply; and selecting a best fit operating frequency based on said main power supply and a stored table of values containing a set of values using a processor;

wherein said adjusting sets said operating frequency to said best fit operating frequency; and wherein each of said values in said stored table of values is a best fit operating frequency given a set main power supply.

10. The method of claim 9, wherein said processor adjusts both said control waveform and said operating frequency during said adjusting.

11. The method of claim 9, further comprising the steps of:

sending information to said processor from an external device using a data port;

wherein said processor adjusts one of said control waveform and said operating frequency based on said information.

12. The method of claim 9, further comprising the steps of:

sensing said intermediate power supply; and calculating a best fit operating frequency based on said intermediate power supply using said processor;

wherein said adjusting sets said operating frequency to said best fit operating frequency.

13. The method of claim 9, further comprising the steps of:

sensing a set of at least one operating conditions of said lamp; and calculating a desired waveform necessary to keep a desired lamp parameter within a desired range based on said set of at least one operating conditions using said processor;

wherein said adjusting sets said control waveform to said desired waveform.

14. The method of claim 13, further comprising the steps of:

logging said set of at least one operating conditions of said lamp in a data file; and calculating said desired waveform based on said data file.

15. A luminaire, comprising:

a lamp;

a processor;

a power factor correction circuit configured to receive a main power supply, and generate an intermediate power supply; and a ballast operatively coupled to said lamp, configured to receive said intermediate power supply, and generate a lamp power supply using a dual gate amplifying drive being driven by a control waveform;

wherein said processor can adjust said control waveform, sense a set of at least one operating conditions of said lamp, calculate a desired waveform necessary to keep a desired lamp parameter within a desired range based on said set of at least one operating conditions, and adjust said control waveform to said desired waveform.

16. The luminaire of claim 15, wherein:

an operating condition in said set of at least one operating conditions is a wattage of said lamp; and said desired lamp parameter is also said wattage of said lamp.

17. The luminaire of claim 16, wherein said processor is configured to:

log said set of at least one operating conditions of said lamp in a data file; and calculate said desired waveform based on said data file.

* * * * *